US009413099B2

(12) United States Patent
Vanslambrouck et al.

(10) Patent No.: US 9,413,099 B2
(45) Date of Patent: Aug. 9, 2016

(54) FEED THROUGH PANEL CONNECTOR WITH SEAL

(71) Applicant: Molex, LLC, Lisle, IL (US)

(72) Inventors: Mike Vanslambrouck, Ray, MI (US); Joe Mauney, South Lyon, MI (US); Vijy Koshy, Lapeer, MI (US)

(73) Assignee: Molex, LLC, Lisle, IL (US)

( * ) Notice: Subject to any disclaimer, the term of this patent is extended or adjusted under 35 U.S.C. 154(b) by 2 days.

(21) Appl. No.: 14/382,052

(22) PCT Filed: Feb. 28, 2013

(86) PCT No.: PCT/US2013/028135

§ 371 (c)(1),
(2) Date: Aug. 29, 2014

(87) PCT Pub. No.: WO2013/130692

PCT Pub. Date: Sep. 6, 2013

(65) Prior Publication Data

US 2015/0011108 A1 Jan. 8, 2015

Related U.S. Application Data

(60) Provisional application No. 61/605,281, filed on Mar. 1, 2012.

(51) Int. Cl.
*H01R 13/73* (2006.01)
*H01R 13/52* (2006.01)
(Continued)

(52) U.S. Cl.
CPC ..... *H01R 13/521* (2013.01); *H01R 4/12* (2013.01); *H01R 13/5202* (2013.01); *H01R 13/6272* (2013.01); *H01R 13/743* (2013.01)

(58) Field of Classification Search
CPC ..... H01R 13/74; H01R 13/5202; H01R 13/6584; H01R 13/5205; H01R 13/5219; H01R 13/5221; H01R 33/965
USPC ..... 439/546, 548, 559, 271
See application file for complete search history.

(56) References Cited

U.S. PATENT DOCUMENTS 4,029,953 A * 6/1977 Natoli ..... B60Q 3/044 362/382
4,684,190 A * 8/1987 Clark ..... H01R 13/5219 439/277

(Continued)

FOREIGN PATENT DOCUMENTS

JP 2010-139053 A 6/2010

OTHER PUBLICATIONS

International Search Report for PCT/US2013/028135.

*Primary Examiner* — Abdullah Riyami
*Assistant Examiner* — Thang Nguyen
(74) *Attorney, Agent, or Firm* — Clarence R. Moon

(57) ABSTRACT

The disclosure relates to a panel connector for locking to a pass-through opening of a panel to allow electrical connection from one side of the panel to the other side. This connection can be considered to be of an outside-in type. The connector can seal the pass-through opening to resist passage dirt, debris and/or liquids. A channel provided on the connector can include a sealing gasket and can receive an annular rib disposed on the panel to create an effective and robust seal against even pressurized water spray. The connector can also prevent unlocking of the connector from the panel once locked to the panel. A resilient locking arm provided on the connector for engaging a mating slot of the panel opening can prevent counter rotational unlocking and detent member can prevent continued rotation after the connector is in the locked position.

13 Claims, 7 Drawing Sheets

(51) Int. Cl.

| | |
|---|---|
| ***H01R 4/12*** | (2006.01) |
| ***H01R 13/627*** | (2006.01) |
| ***H01R 13/74*** | (2006.01) |

(56) References Cited

U.S. PATENT DOCUMENTS 5,277,610 A 1/1994 Krehbiel et al.
5,759,064 A 6/1998 Sugiyama
6,083,040 A * 7/2000 Mosquera ..... H01R 13/5202 439/548
6,109,960 A 8/2000 Cooper et al.
6,508,666 B1 * 1/2003 Francis ..... H01R 13/745 439/282
6,634,897 B2 * 10/2003 Cykon ..... H01R 43/18 439/318
6,853,316 B2 * 2/2005 Payson ..... H04L 49/351 340/999
7,090,533 B1 8/2006 Houck et al.
7,357,669 B2 * 4/2008 Gabet ..... H01R 4/64 439/549
7,597,587 B1 10/2009 Duesterhoeft
8,469,742 B2 * 6/2013 Shiga ..... H01R 13/5208 439/587

* cited by examiner

FEED THROUGH PANEL CONNECTOR WITH SEAL

RELATED APPLICATIONS

This application claims priority to U.S. Provisional Application Ser. No. 61/605,281, filed Mar. 1, 2012, which is incorporated herein by reference in its entirety.

TECHNICAL FIELD

The present disclosure relates to electrical connectors and in particular, to bulkhead, panel or feed-through connectors for electrical use. In particular, the panel connectors disclosed herein can seal against the panel to provide some measure of water and weather resistance. More particularly, the disclosure is directed to panel connectors that can be sealingly locked to the panel by twisting or rotation of the connector and that can be locked to the panel from the outside. Even more particularly, the disclosure is directed to panel connectors that cannot be unlocked once locked to the panel.

BACKGROUND ART

Panel electrical connectors are typically used to provide electrical connections through a pass-through or feed-through hole from one side of a bulkhead, wall or panel to the other side. Typically, the panel can separate two spaces or areas from each other. For example, a panel or wall can separate an engine compartment from a passenger compartment of a vehicle. One of the areas can be referred to as a module area and another as an outer area. Generally, the module area can simply be the area that has more limited accessibility then the outer area. One example would be a panel that makes up part of an enclosure. The inside of the enclosure could be considered as the module area even though the term module area is not limited to an enclosed space. Accordingly, a panel connector can provide an electrical connection from the outside to the interior of the enclosure. Panel connectors are suitable for use in a wide variety of applications such as for example power generation and supply systems, and aeronautic and automotive applications.

Panel connectors may be configured to lock to the panel and allow removal or unlocking of the connector, or to prevent unlocking or removal from the panel. Some lockable panel connectors can have two parts. A mounting part can be mounted to the panel opening and the connector part can lock with the mounting part. These two-part connectors typically require access to both sides of the panel, which may be difficult especially in the case of cramped enclosures or other module areas. There are also one-piece panel connectors that are configured to interact or mate with the pass-through hole in the panel, which has complementary or interacting locking structures.

For certain uses, the panel connector may include the ability to seal against the panel to prevent dirt, debris or liquid from an exposed side of the panel to enter the other side of the panel. Typically, in order to provide watertight sealing and/or to prevent removal of the panel connector, the connector is made to be installed to the module area side of the panel, which can be referred to as an inside-out installation. In this type of inside-out installation, the connector can be locked against and even sealed to the panel side facing the module area with one of the connector ends extending into the module area and an opposite end extending through the pass-through hole into the other or outer area. With inside-out installations for connectors having an end passing through the panel opening and extending towards the outer area for mating with a push-in or plug-in type connector, pushing against the panel connector from the outer area can cause the panel connector to be pushed out of engagement with the panel and/or can diminish the integrity of the seal between the panel connector and the panel. Inside-out installation also tends to be difficult and/or time consuming mostly due to the tight spaces involved.

SUMMARY OF THE INVENTION

The present disclosure concerns panel connectors that provide simple locking and effective and robust sealing in an outside-in installation where the panel connector locks to the outside face or the more accessible side of the panel and provides a watertight seal. In an aspect of the disclosure a connector has a simple locking mechanism and the ability to prevent unlocking and/or disengagement of the connector from the panel.

In one aspect, the present disclosure is directed to an electrical connector for locking to a panel having an annular rib extending from an outer surface of the panel and surrounding a pass-through hole having an engagement lip and a stop surface. The connector includes a housing having an insertion portion at one end of the housing for entering the pass-through hole and an outer portion at an opposite end of the housing, a flange and a sealing gasket. The insertion portion includes a locking member and a first engagement member positioned about an outer wall of the insertion portion. The flange extends radially outwardly from the housing adjacent the insertion portion and includes a channel at an outer end portion thereof facing in the direction of the insertion portion for receiving the annual rib. The flange is spaced apart from the first engagement member to define a gap for receiving the engagement lip to lock the connector to the panel. The sealing gasket is disposed in the channel about an inner wall of the channel for radial compression between an inner surface of the annular rib and the inner wall, wherein insertion of the insertion portion into the pass-through hole causes the annular rib to enter the channel, and rotation of the connector causes the engagement lip to enter the gap to lock the connector to the panel and moves the locking member into engagement with the stop surface to restrict counter-rotation and removal of the connector.

In another aspect, the present disclosure is directed to a twist-lock electrical connector for use with a panel separating an open area and a module area with the panel having a pass-through hole including two engaging lips having detent surfaces, a deflecting tab defining a mating slot having a stop surface and an annular rib circumscribing the opening and extending into the open area. The connector includes a housing having a cylindrical insertion portion at one end for entering the pass-through hole and a mating connector portion at an opposite end; a resilient locking member and two locking tabs disposed about the cylindrical insertion portion, one of the locking tabs includes a detent member; a flange extending radially outwardly from the housing adjacent the insertion portion and spaced axially apart from the locking tabs to define first and second gaps therebetween for capturing the first and second engaging lips to lock the connector to the panel; a channel formed around the outer end of the flange and facing in the direction of the panel for receiving the annular rib, the channel defined by an inner wall, a base wall and an outer wall; and a sealing gasket positioned in the channel and against the inner wall such that an engagement surface faces the outer wall for sealing compression between the inner wall and an inner surface of the annular rib to form a seal between the connector and the panel. Insertion of the insertion portion into the pass-through hole causes the annular rib to engage the channel and rotation of the connector causes the locking member to engage the deflecting tab and deflect until mating with the mating slot at which point the detent member engages the detent surface to restrict continued rotation and wherein the stop surface cooperates with the locking member to restrict counter-rotation.

In yet another aspect, the present disclosure is directed to a twist-lock connector for locking engagement to a panel. The connector includes a housing having an insertion portion, an intermediate portion and an end portion; a deflectable locking arm disposed on an outer cylindrical surface of the insertion portion; a flange extending radially from the intermediate portion and having a channel at an outer end thereof, the channel facing in the direction of the insertion portion, first and second locking tabs disposed on the outer cylindrical surface of the insertion portion and spaced apart from the flange to define first and second gaps respectively therebetween, at least one of the first and second locking tabs including a detent member; and a sealing gasket positioned in the channel and against an inner wall of the channel such that an engagement surface of the sealing gasket faces an opposing outer wall of the channel for radial sealing compression. Insertion of the insertion portion into a pass-through hole in a panel moves an annular rib surrounding the pass-through hole into the channel for sealing engagement with the sealing gasket, and rotation of the twist lock connector causes entry of engagement members of the panel into first and second gaps, capture by the locking tabs and deflection of the locking arm, until the detent member engages a detent surface of the panel opening to restrict continued rotation at which point the locking arm engages a slot in the opening of a panel to restrict counter-rotation of the twist-lock connector.

BRIEF DESCRIPTION OF THE DRAWINGS

In the following detailed description, reference will be made to the following drawings, in which like reference numerals refer to like components, and in which.

DETAILED DESCRIPTION

The detailed embodiments disclosed herein are merely exemplary of the inventions disclosed herein, which may be embodied in various forms, and specific details disclosed herein are not to be interpreted as limiting, but merely as a basis for the claims and as a representative basis for teaching one skilled in the art to variously employ the present approach in virtually any appropriate manner.

Figure 1:
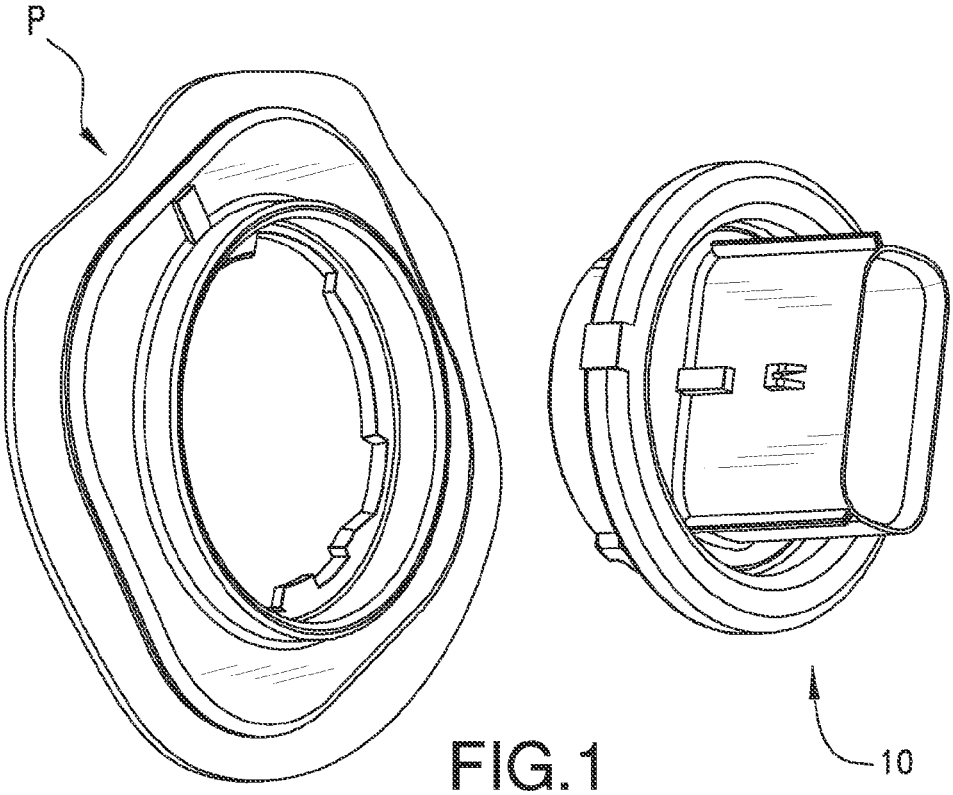
FIG. 1 is a perspective view of one embodiment of a panel connector for locking to a panel according to the present disclosure.
Figure 2:
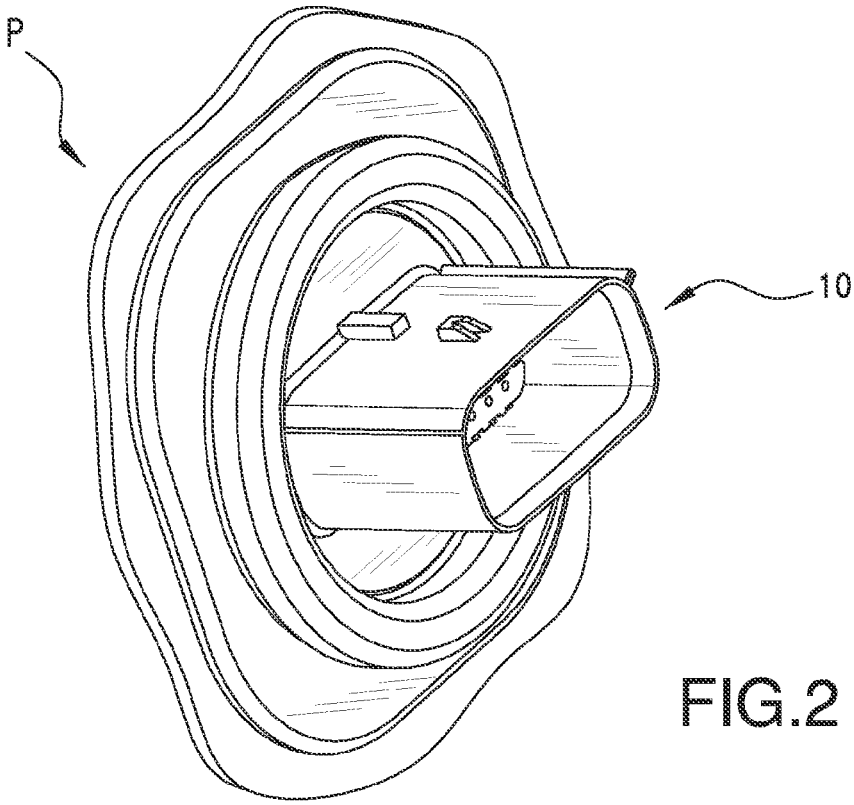
FIG. 2 is a perspective view of the panel connector of FIG. 1 locked to a panel according to the present disclosure.
Figure 3:
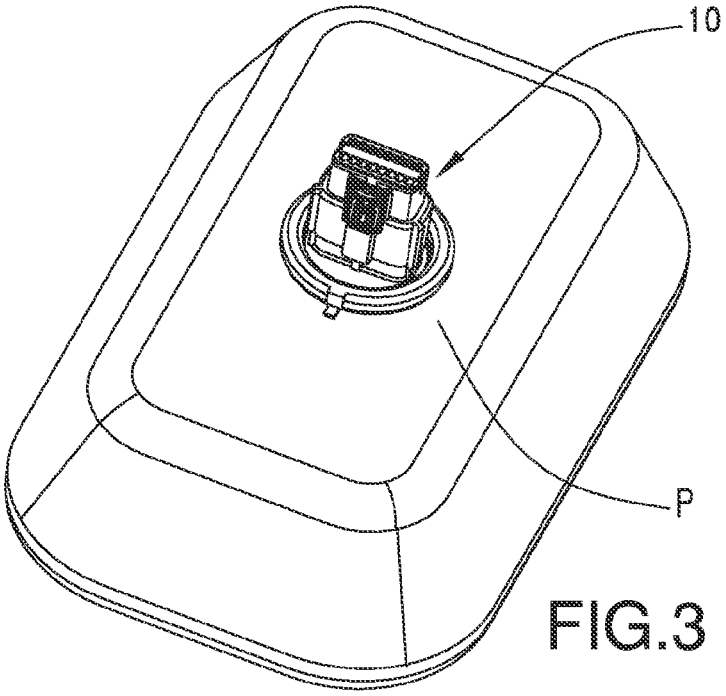
FIG. 3 is a perspective view of another embodiment of a panel connector according to the present disclosure locked to a panel that is part of an enclosure.

FIGS. 1 and 2 show one embodiment of a panel connector 10 disengaged and engaged to a panel "P", respectively. Panel "P" can be part of a wall of an enclosure as shown in FIG. 3 or a wall separating two compartments (not shown). The connector 10 can include features which interact or cooperate with complementary features of panel "P". The features of the panel which cooperate with connector 10 to providing locking, sealing and/or removal prevention can be included as part of the panel or can be included on a separate panel opening adapter which can mount to a typical pass through hole of a panel "P". Accordingly, the term "panel" used herein is understood to refer to either panel itself or a panel adapter.

In one embodiment, panel connector 10 can be a single piece connector for locking to a panel through rotation of the connector and can provide electrical connection from one side of the panel to the other. The panel can include a pass through hole structured to cooperate with structures of connector 10. Connector 10 can provide electrical connection including signal and/or power through the pass through hole and can include a variety of electrical connection interfaces at both ends of the connector 10. The connector 10 can lock to the panel with or without providing sealing to retard or prevent passage of dirt, debris and/or liquid through the pass through hole. In one embodiment, connector 10 can be locked to the panel "P" to provide a desired sealing rating. The connector can also include features to prevent removal or unlocking of the connector from the panel. Indeed, the panel connector can include one or more of the above identified features in any combination.

Figure 4:
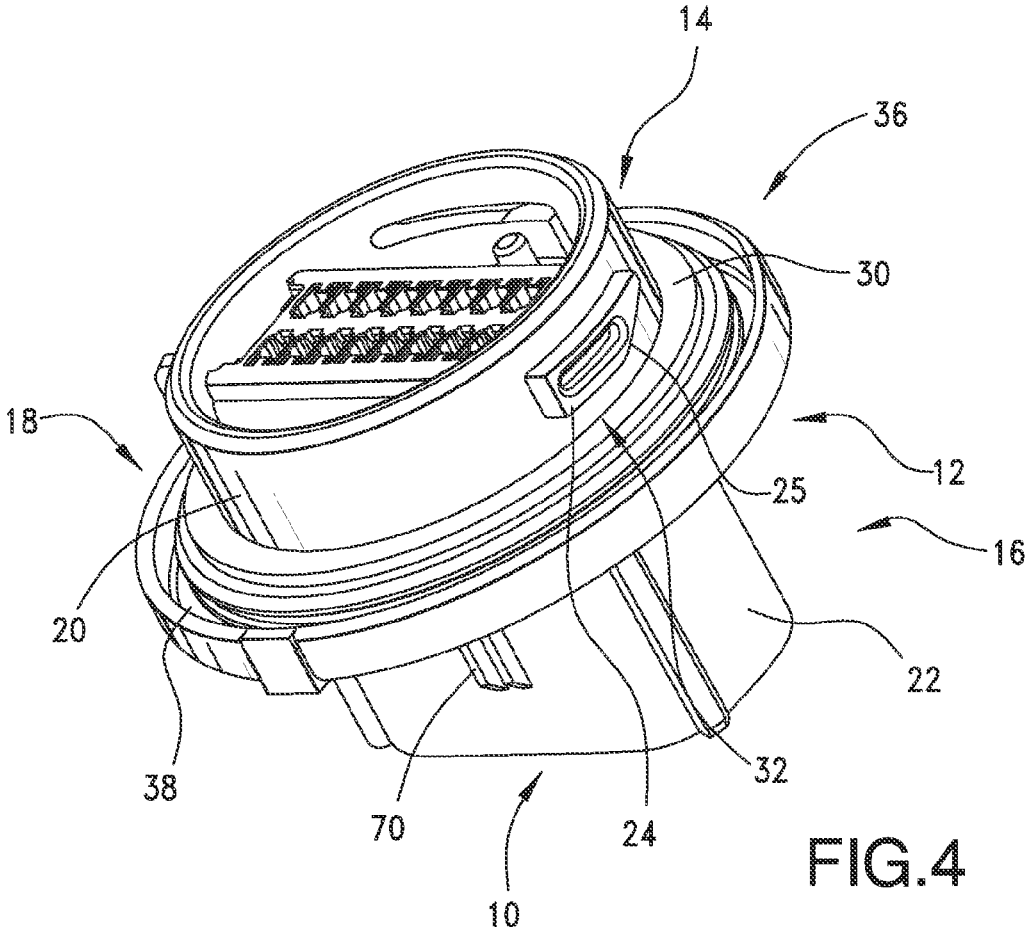
FIG. 4 is a perspective view of another embodiment of a panel connector according to the present disclosure.
Figure 5:
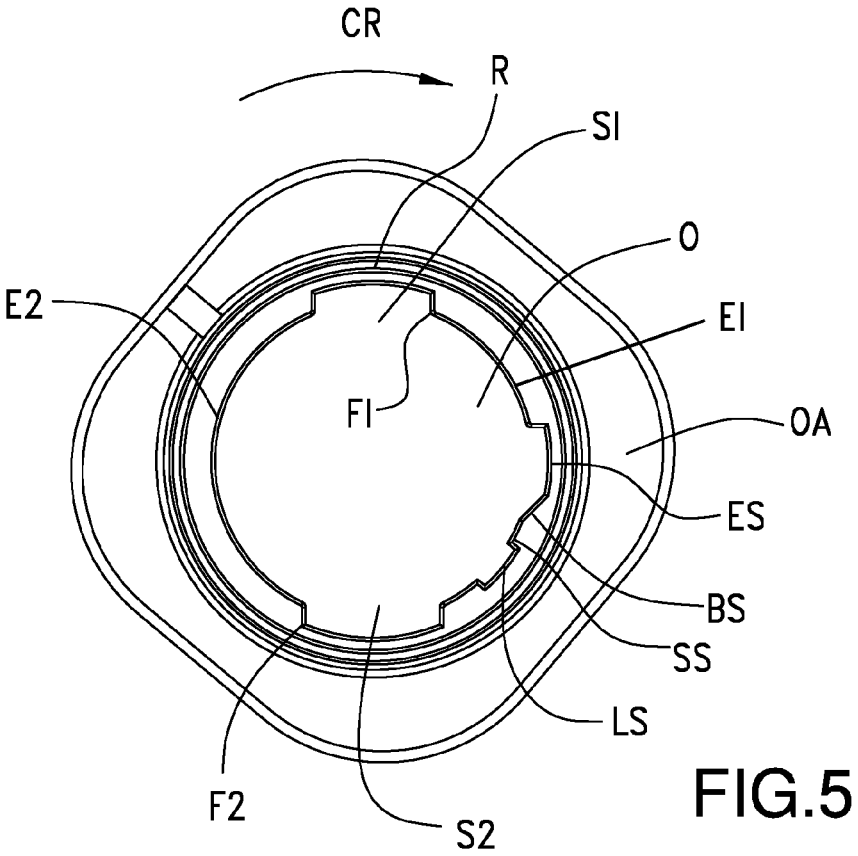
FIG. 5 is a perspective view of a one embodiment of a panel for locking with a panel connector according to the present disclosure.

In one embodiment shown in FIG. 4, panel connector 10 can have housing 12. Housing 12 can have an insertion portion 14 at one end, an outer portion 16 at an opposite end and an intermediate portion 18 therebetween. Insertion portion 14 can have a cylindrical wall 20 configured to enter a module area through a panel pass through hole or opening such as opening "O" of one embodiment of a panel "P" shown in FIG. 5. FIG. 5. shows panel "P" from the outer area. Intermediate portion 18 can be sized larger than opening "O" to prevent connector 10 from completely passing through the opening "O". Outer portion 16 can reside on the outer area of panel "P" when insertion portion 14 is inserted into opening "O" as shown in FIG. 2. Outer portion 16 can have a generally rectangular wall 22. It is understood that the shape of the housing can vary and is not limited to the embodiment shown in FIG. 4. It is preferable that the shape of intermediate portion 16 generally corresponds to the shape of the pass through opening especially when sealing of the opening is desired.

Figure 6:
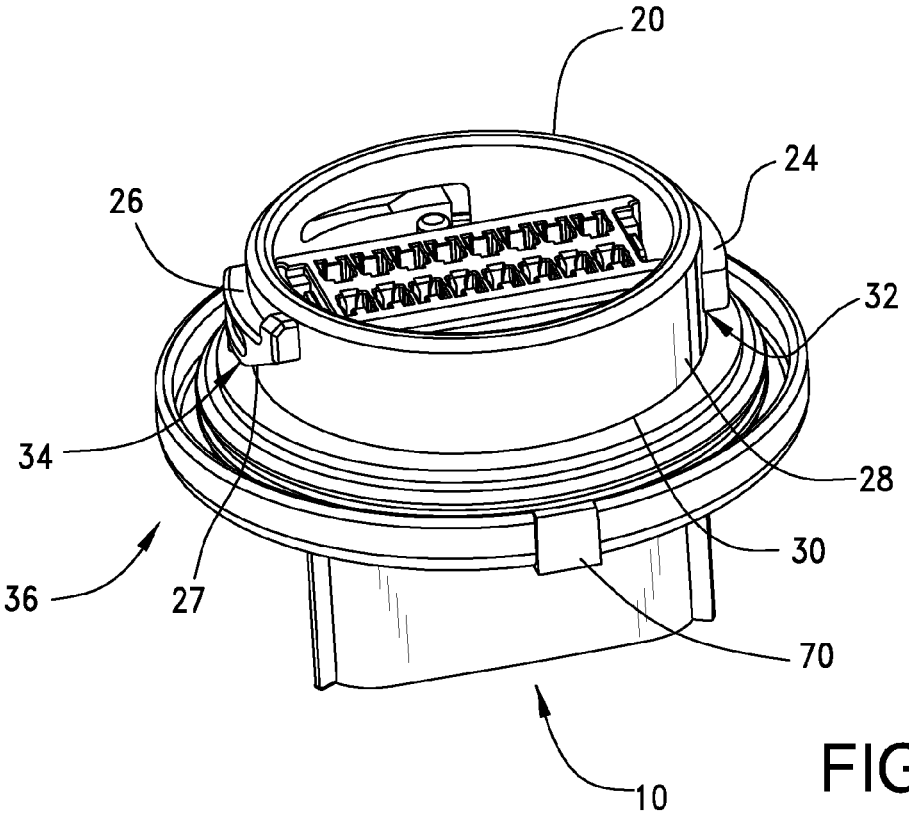
FIG. 6 is another perspective view of the panel connector shown in FIG. 4 according to the present disclosure.
Figure 7:
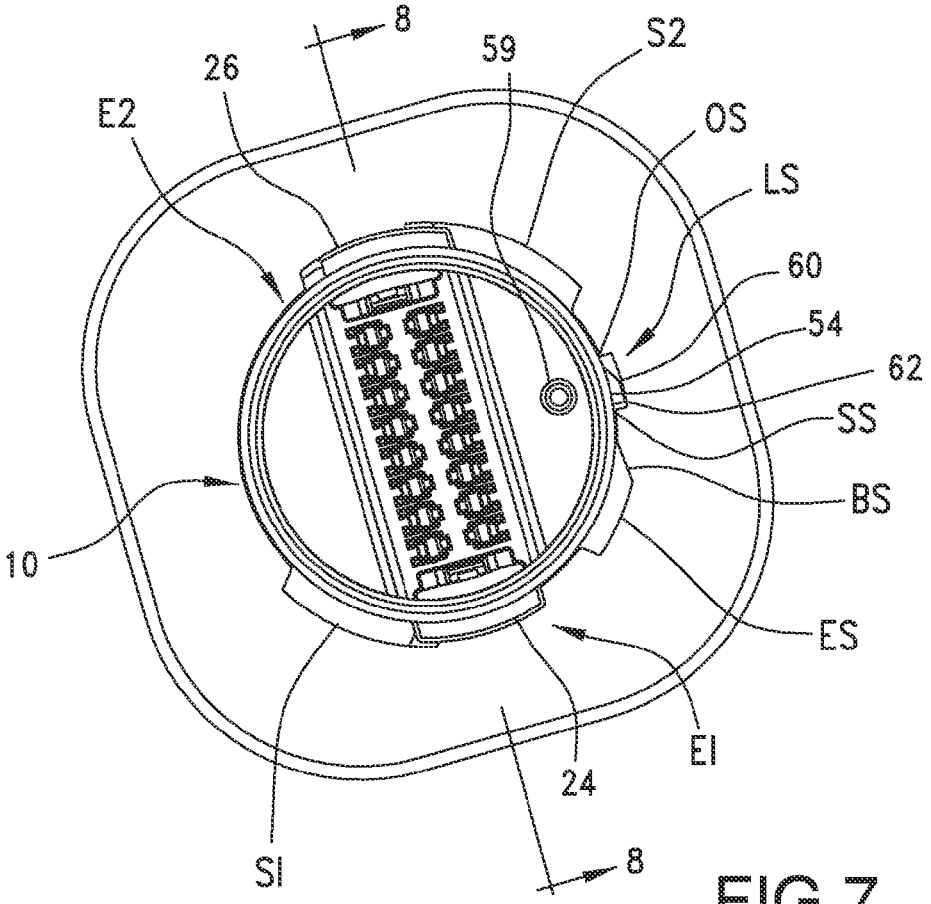
FIG. 7 is an elevation view of the panel connector shown in FIG. 6 locked to a panel according to the present disclosure.

In one embodiment, connector 10 can include at least one engagement member 24 to lock or secure connector 10 to panel "P". As shown in FIG. 6, connector 10 can have two engagement members 24, 26 disposed on outer surface 28 of circular wall 20. In another embodiment, connector 10 can have more than two engagement members. As shown in FIG. 6 engagement members 24, 26 can be disposed at opposite sides of circular wall 20 and spaced apart from annular surface 30 of intermediate portion 18 to define gaps 32, 34 therebetween. Gaps 32, 34 can receive portions of the panel "P". For example, with reference to FIG. 5, panel opening "O" can include two slots "S1", "S2" sized to allow engagement members 24, 26 to enter opening "O" therethrough. Slots "S1", "S2" can define adjacent engagement lips "E1", "E2" which upon rotation of connector 10 can enter gaps 32, 34. Engagement lips "E1", "E2" can be the portions of panel "P" that are adjacent corresponding slots "S1", "S2" in the direction of locking rotation. The locking rotation as viewed in FIG. 5 is the clockwise direction shown by arrow "CR". The portions of engagement lips "E1", "E2" received in gaps 32, 34 can be trapped between engagement members 24, 26 and annular surface 30 to secure or lock connector 10 to panel "P". FIG. 7 shows connector 10 in the locked position as viewed from the module area.

Optionally, one or more of engagement members 24, 26 can each include a cam surface 25, 27 respectively (FIGS. 4 and 6). In particular, cam surfaces 25, 27 can be positioned on the leading side or the side facing the direction of rotation such that on the occasion that insertion portion 14 is not fully inserted through pass-through opening "O" rotation of connector 10 sloping surfaces 25, 27 can contact the axially extending faces F1, F2 of engagement lips E1, E2 and transfer some of the rotational motion to axial movement in the direction of insertion. The angle of cam surfaces 25, 27 can be from about 15 to about 60 degrees, more preferably from about 25 to about 50 degrees and even more preferably from about 30 to about 45 degrees. In the embodiment shown in FIGS. 4 and 6 the angle of cam surfaces 25, 27 can be about 45 degrees.

In one embodiment, engagement members 24, 26 and corresponding slots S1, S2 can be sized or shaped differently to provide a keying function to ensure desired alignment of the connector such that the connector cannot be mounted to the panel in an inverted position. For example, engagement member 24 and slot S1 can have a greater radial length than engagement member 26 and slot S2. In another embodiment, instead of being differently sized or shaped to ensure proper alignment, engagement members 24, 26 can be disposed asymmetrically about circular wall 20. For example, instead of having engagement members 24, 26 disposed at directly opposite sides of circular wall 20, i.e. positioned at 180 degrees from each other, engagement members 24, 26 can be disposed at from about 170 to about 179 degrees from each other.

Figure 8:
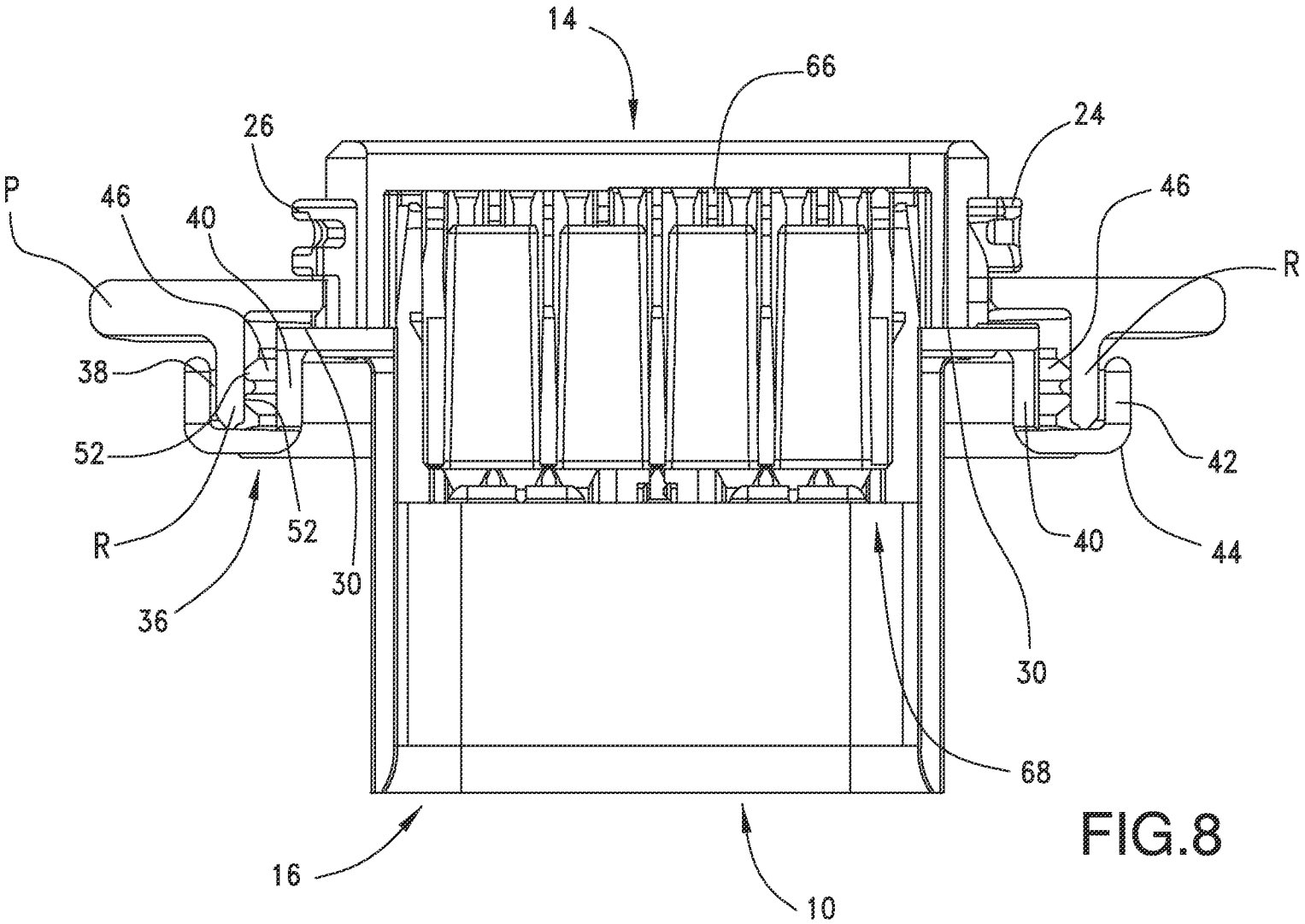
FIG. 8 is a cross-sectional view taken along line 8-8 of FIG. 7.

Connector 10 can also include the ability to seal the pass-through hole "O" of panel "P". In one embodiment, Intermediate portion 18 can have flange 36 extending radially outwardly therefrom. Flange 36 can include annual surface 30 at its inner end and channel 38 at an outer end of the flange 36. Channel 38 can be open in the direction of the insertion portion 14 for receiving annular rib "R" which can extend from the side "OA" of the panel facing the outer area as shown in FIG. 5. As shown in FIG. 8, channel 38 can have parallel inner wall 40 and outer wall 42 both extending in an axial direction and a bridging wall 44 extending in a radial direction connecting inner wall 40 and outer wall 42.

Figure 9:
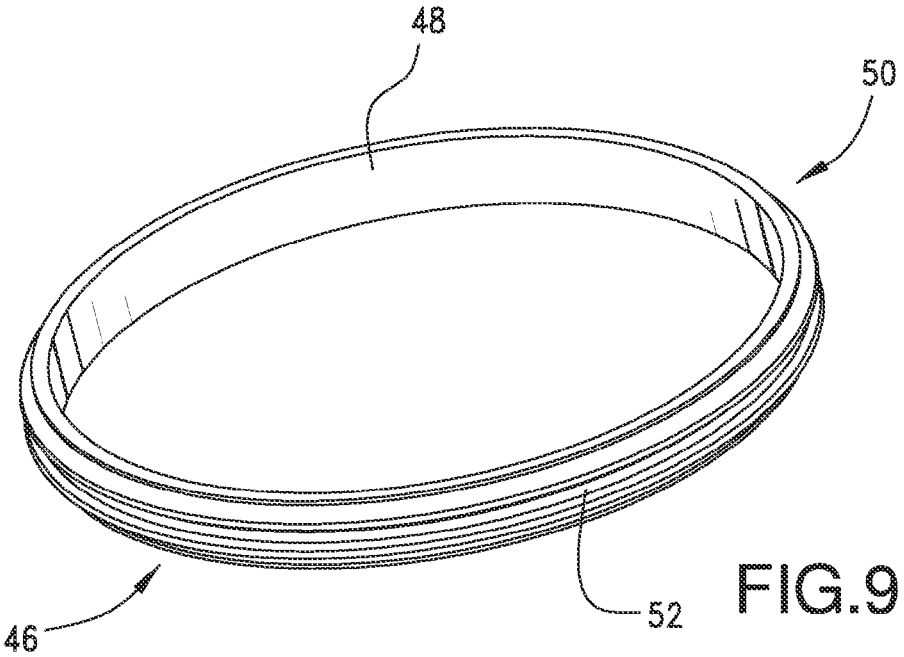
FIG. 9 is a perspective view of one embodiment of a sealing gasket according to the present enclosure.

An annular sealing gasket 46 can be disposed in channel 38. Annular sealing gasket 46 shown in FIG. 9 can have a resting surface 48 and an opposite engaging surface 50. Engaging surface can be ribbed or have ridges 52 for sealing against annular rib "R" in a radial direction. As shown in FIG. 8 resting surface 48 can be disposed against inner wall 40 such that ridges 52 extend in the radial direction. Sealing gasket 46 can have a diameter smaller than the diameter of intermediate portion 18 and in particular smaller than the diameter measured between opposite sides of inner wall 40 such that sealing gasket 46 can be stretched in order to be placed about inner wall 40. The elasticity of the sealing gasket 46 can hold gasket 46 in place. Channel 38 can be sized such that entry of the annular rib "R" compresses radially against ridges 52 to create a seal. In one embodiment, the seal created by the above-described arrangement can have an I6K7 and/or IP6K9K sealing performance For example the combination of radial sealing compression combined with protective outer wall 42 can provide a seal effective against pressurized water spray testing. Sealing gasket 46 can be made from an elastomeric material such as rubber based elastomeric material, a silicone based elastomeric material or a composite elastomeric material. In one embodiment sealing gasket 46 can be made from a silicone elastomeric material.

Figure 10:
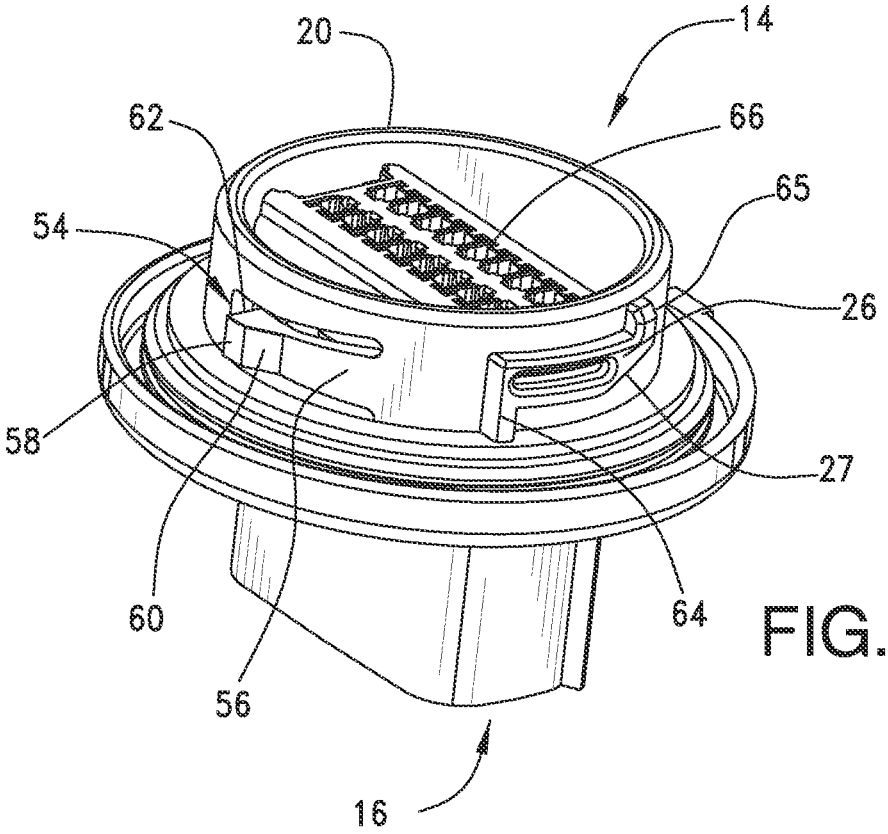
FIG. 10 is yet another perspective view of the panel connector shown in FIG. 4 according to the present disclosure.

Optionally, connector 10 can include a locking mechanism for preventing or resisting unlocking connector 10 from the panel "P". In one embodiment shown in FIG. 10, connector 10 can have a resilient locking member 54. Locking member 54 can have a cantilevered arm 56 and a locking tab 58 at an end of the arm 56. Tab 58 can extend radially outwardly in a direction away from circular wall 20. Cantilever arm 56 can move from the locked or rest position shown in FIG. 10 to a retracted position (see FIG. 12). Cantilevered arm 56 can be formed from a cut-out region of circular wall 20. Tab 58 can include an angled surface 60 on the side of tab 58 facing the direction of rotation and an upright surface 62 on the opposite side of tab 58 as shown in FIGS. 7 and 10. Locking member 54 can cooperate with panel "P" to resist counter-rotation and unlocking of connector 10 once the locking member has properly engaged panel "P" as discussed below.

With reference to FIG. 5 which shows the side "OA" of panel "P" facing the outer area and FIG. 7 which shows the side of panel "P" facing the module area, opening "0" can have an entry slot "ES" for allowing entry of tab 58 and locking slot "LS" for receiving tab 54 following deflection of tab 58 when the connector 10 is in the locked position. Tab 58 can be positioned axially along circular wall 20 such that when insertion portion 14 has entered opening "O", rib "R" has entered channel 38 and engagement members 24, 26 have entered through slots "S1", "S2" tab 54 can reside in entry slot "ES". Entry slot "ES" can include a biasing surface "BS" positioned to engage angled surface 60 of tab 58 upon rotation in the locking direction, and locking slot "LS" can include an upright stop surface "SS" in facing relation with and for contacting upright surface 62 of tab 58 when connector 10 is in the locked position. Alternatively, biasing surface "BS" and stop surface "SS" can be considered as part of a biasing tab positioned between entry slot "ES" and locking slot "LS". The slope or angle of biasing surface "BS" and angled surface 60 can be similar to each other. For example, biasing surface "BS" and angled surface 60 each can be from about 15 to about 60 degrees, more preferably from about 25 to about 50 degrees and even more preferably from about 30 to about 45 degrees. In one embodiment, the angle of both biasing surface "BS" and angled surface 60 can be about 30 degrees.

Figure 11:
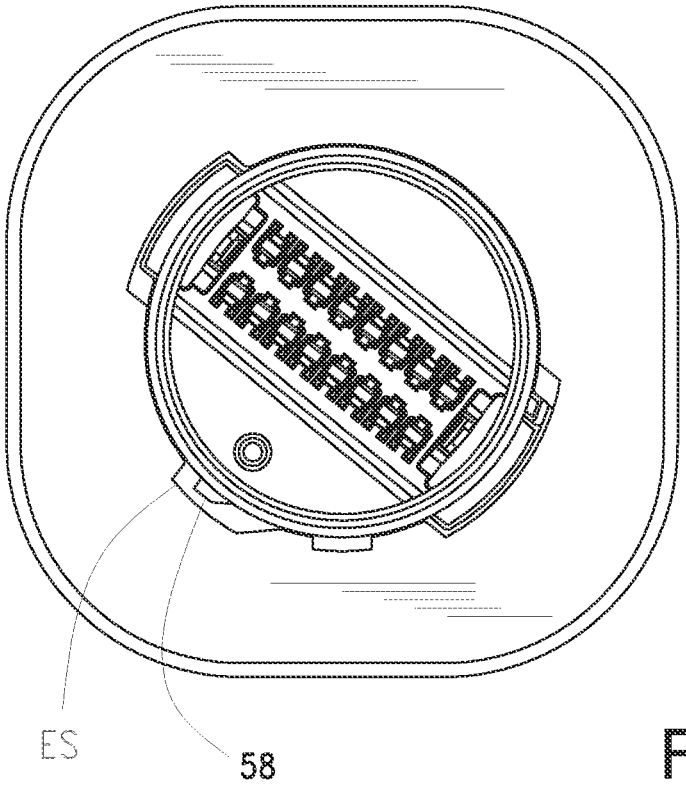
FIG. 11 is an elevation view of the panel connector shown in FIG. 6 inserted into a panel according to the present disclosure.
Figure 12:
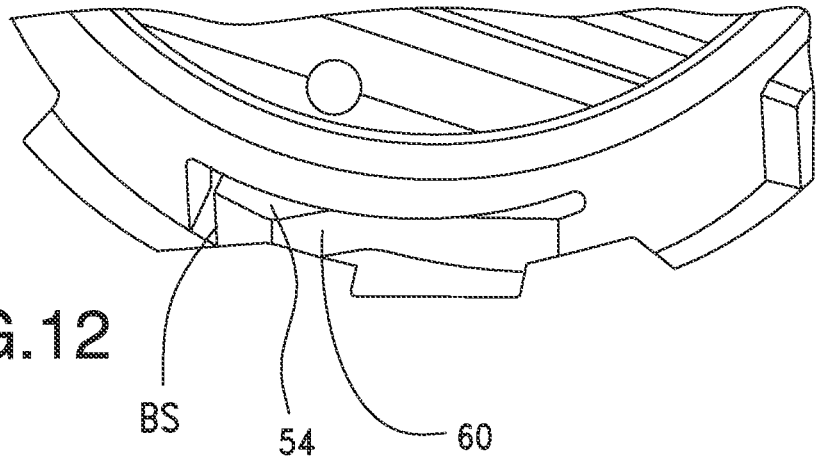
FIG. 12 is a detailed perspective view of the panel connector shown in FIG. 11 inserted into a panel just prior to being locked to the panel according to the present disclosure.

At the insertion position shown in FIG. 11, locking tab 58 resides in entry slot "ES". Rotation of the connector 10 is shown by the counter-clockwise arrow since the view is from the module side of the panel "P". Such rotation can cause angled surface 60 to contact biasing surface "BS" and deflect tab 58 radially inwardly towards the center of connector 10 as shown in FIG. 12. Tab 58 can remain in this deflected position with further rotation until the tab rebounds upon encountering locking slot "LS" as shown in FIG. 7. FIG. 7 shows the connector 10 in the locked position. Support post 59 positioned on the inside of circular wall 20 can prevent cantilever arm 56 from over deflection such as during handling or shipment.

In this locked position, the connector can resist counter-rotation to resist or prevent removal of connector 10 since counter-rotation can result in upright surface 62 of tab 58 abutting or contacting stop surface "SS" of locking slot "LS". The contacting of stop surface "SS" with upright surface 62 can prevent counter rotation once tab 58 mates or engages with locking slot "LS". Connector 10 can also prevent or resist unlocking or removal of connector 10 from panel "P" by resisting or preventing continued rotation or rotation in the locking direction, i.e. clockwise when viewed from the outer area as shown in FIG. 5 and counter-clockwise when viewed from the module area as shown in FIGS. 7 and 11.

In one embodiment, tab 58 can have an a second upright surface instead of angled surface 60 for contacting opposing stop surface "OS" shown in FIG. 7 when the connector 10 is further rotated in the locking direction. The upright surface which can replace angled surface 60 can still allow tab 58 to be deflected by biasing surface "BS" with an appropriately sloped surface such as biasing surface having a 10-30 degree inclination.

In another embodiment as shown in FIG. 10, connector 10 can have a detent member 64 for engaging or contacting a stop surface of panel "P". In the embodiment shown in FIG. 10, detent member 64 can be part of one of the engagement member such as engagement member 26 and extend axially from an end opposite sloping surface 27 in the direction towards outer end 16. When connector 10 is rotated in the locking direction, detent member 64 can contact axially extending face "F2" of engagement lip E2 upon tab 58 engaging locking slot "LS" or slightly thereafter (see FIG. 5). In other words, the distance traveled by tab 58 from entry slot "ES" to locking slot "LS" should equal or be slightly less than the distance traveled by detent member 64 before contacting a detent surface such as axially extend face "F2". In another embodiment both engagement members 24, 26 can have a detent member. Alternatively, the side of panel "P" facing the module area can have a stop surface which can be contacted by another part of engagement members 24, 26, such as forward or leading surface 65 shown in FIG. 10.

Connector 10 can house a variety of connection interfaces to permit electrical connection to insertion portion 14 and outer portion 16. For example, insertion portion 14 can have one or more female connection ports for receiving terminals from another connector or electrical device in the module area and outer portion 16 can have male terminals or contacts for connecting to another mating connector or electrical device. This arrangement can also be reversed. In one embodiment, connector 10 can have one or more passages 66 as shown in FIGS. 8 and 10 that can extend from the insertion portion towards the outer portion. Passages 66 can receive blade terminals (not shown) attached to wires or other conductors such that the ends of the blade terminal extend through passages 66 and towards and emerging at the outer end portion 16 for subsequent mating with a mating connector shown in FIG. 3. Connector 10 can have two rows of 4, 6, or 8 passages 66. Interior of connector 10 can include positive latch reinforcement (PLR) features 68. Connector 10 can also include connector position assurance (CPA) components.

Figure 13:
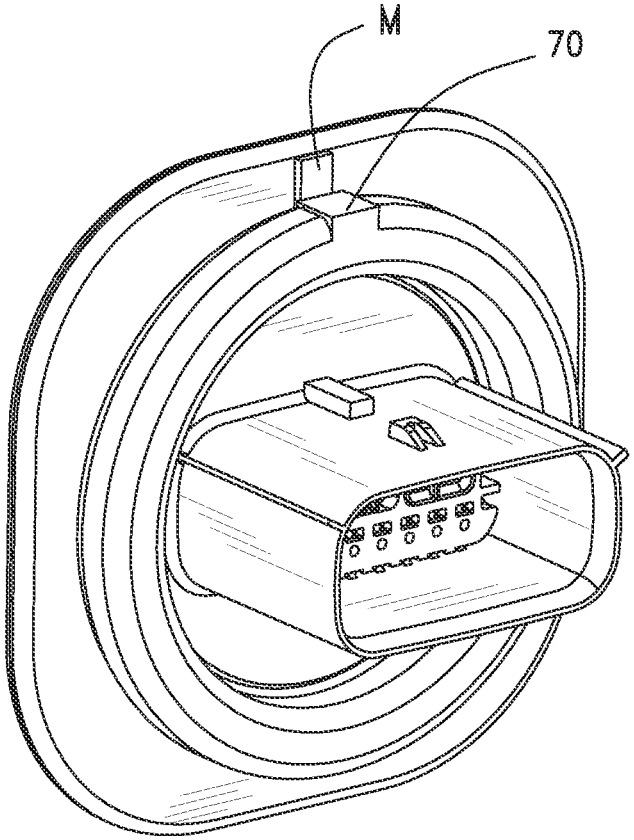
FIG. 13 is a perspective view of the panel connector of FIG. 6 locked to a panel according to the present disclosure.

Optionally, housing 12 can include a latch member 70 at the outer portion 16 for locking connector 10 to a mating connector mated at the outer portion 16. In addition, housing 12 can include a visual marker to signal that the connector is in the fully locked position. For example flange 36 can include marker 70 (FIG. 6) which can align with complementary marker "M" on panel "P" as shown in FIG. 13 when in connector 10 is in the locked position.

Many different materials can be used to construct housing 12. In one embodiment housing 12 can be made from a plastic or polymer material or polymer composite material. For example housing 12 can be made from a composite nylon polymer. In one embodiment connector housing 12 can be made from 20% glass filled SPS nylon blend.

While the present subject matter disclosed herein has been described in detail with reference to the foregoing embodiments, other changes and modifications may still be made without departing from the spirit or scope of what is disclosed. It is understood that the specific structures, and arrangements described herein are not to be limited by the embodiments described herein.

The invention claimed is:

1. An electrical connector for locking to a panel having an annular rib extending from an outer surface of the panel and surrounding a pass-through hole having an engagement lip and a stop surface, the connector comprising:

a housing having an insertion portion at one end of the housing for entering the pass-through hole and an outer portion at an opposite end of the housing, the insertion portion including a locking member and a first engagement member positioned about an outer wall of the insertion portion;

a flange extending radially outwardly from the housing adjacent the insertion portion, the flange including a channel at an outer end portion thereof facing in the direction of the insertion portion for receiving the annual rib, the flange spaced apart from the first engagement member to define a gap for receiving the engagement lip to lock the connector to the panel; and a sealing gasket disposed in the channel about an inner wall of the channel for radial compression between an inner surface of the annular rib and the inner wall, wherein insertion of the insertion portion into the pass-through hole causes the annular rib to enter the channel, and rotation of the connector causes the engagement lip to enter the gap to lock the connector to the panel and moves the locking member into engagement with the stop surface to restrict counter-rotation and removal of the connector.

2. The electrical connector of claim 1 wherein the outer wall of insertion portion is cylindrical and includes first and second engagement members positioned on opposite sides of the cylindrical wall, the first and second engagement members spaced from the flange to define first and second gaps to receive first and second engagement lips of the panel opening to lock the connector to the panel.

3. The electrical connector of claim 2 wherein one of the first and second engagement members includes a stop finger for engaging an end surface of one of the engagement lips to restrict continued rotation once the locking member is in position to engage the stop surface.

4. The electrical connector of claim 2 wherein at least one of the first and second engagement members includes a cam surface on a side facing the direction of rotation for engagement with the respective engagement lip to transfer rotational movement of the connector to axial movement towards the panel.

5. The electrical connector of claim 2 wherein the first and second engagement members are differently sized to restrict insertion of the connector in the panel to a predetermined orientation.

6. The electrical connector of claim 2 wherein the locking member is a cantilevered arm having a protruding nub, the nub including a sloped surface on a side facing the direction of rotation for engagement with a biasing tab of the panel for deflecting the cantilevered arm during locking rotation of the connector and an opposing upright surface for engaging the stop surface after rebounding of the cantilevered arm when the nub moves past the biasing tab.

7. The electrical connector of claim 6 wherein the cylindrical outer wall defines an interior space, the interior space includes a post positioned to contact the cantilevered arm on deflection of the cantilevered arm into the interior space.

8. The electrical connector of claim 1 wherein the panel separates a module area and an open area, and wherein the insertion portion enters the module area through the pass-through hole.

9. An electrical connector comprising:

a housing having an insertion portion, an intermediate portion and an end portion;

a deflectable locking arm disposed on an outer cylindrical surface of the insertion portion;

a flange extending radially from the intermediate portion and having a channel at an outer end thereof, the channel facing in the direction of the insertion portion;

first and second locking tabs disposed on the outer cylindrical surface of the insertion portion and spaced apart from the flange to define first and second gaps respectively therebetween, at least one of the first and second locking tabs including a detent member; and a sealing gasket positioned in the channel and against an inner wall of the channel such that an engagement surface of the sealing gasket faces an opposing outer wall of the channel for radial sealing compression, wherein insertion of the insertion portion into a pass-through hole in a panel moves an annular rib surrounding the pass-through hole into the channel for sealing engagement with the sealing gasket, and rotation of the twist lock connector causes entry of engagement members of the panel into first and second gaps, capture by the locking tabs and deflection of the locking arm, until the detent member engages a detent surface of the panel opening to restrict continued rotation at which point the locking arm engages a slot in the opening of a panel to restrict counter-rotation of the twist-lock connector.

10. The electrical connector of claim 9 wherein a support post is positioned on the inside of the cylindrical surface of the insertion portion to prevent the locking arm from over deflection.

11. The electrical connector of claim 9 wherein the panel separates a module area and an open area, and wherein the insertion portion enters the module area through the pass-through hole.

12. A twist-lock connector for locking to a panel separating an open area and a module area:

the panel comprising: an outer surface facing the open area, a passthrough hole including opposing first and second keying slots, each keying slot defining an adjacent engagement lip, a locking tab slot having a sloped surface, a mating slot having a stop surface and a rib disposed on the outer surface and surrounding the pass-through hole; the connector comprising:

a housing having an insertion portion at one end for entry into the module area through the pass-through hole, an outer portion at an opposite end and an intermediate portion therebetween, the outer portion extending from the intermediate portion and away from the pass-through opening;

a flange extending radially outwardly from the intermediate portion and including a channel at an outer end portion of the flange, the channel facing in the direction of the insertion portion for receiving the rib;

first and second keying tabs disposed about an outer surface of the insertion portion at opposite ends thereof for entering the first and second keying slots upon entry of the insertion portion, the keying tabs spaced apart from the flange to define first and second gaps therebetween for receiving the engagement lips;

a deflectable arm having a locking tab disposed on the outer surface of the insertion portion and between the first and second keying slots; and a sealing gasket positioned in the channel and against an inner wall of the channel such that an engagement surface of the sealing gasket faces an opposing outer wall of the channel for radial sealing compression wherein insertion of the insertion portion into the pass-through hole causes first and second keying tabs to pass through first and second keying slots, the locking tab to enter the locking slot and the rib to mate with the channel, and wherein rotation of the connector moves the key tabs behind the engagement lips to capture the engagement lips between the flange and the keying tab, moving the locking tab into engagement with a sloped surface to cause deflection of the resilient arm until the locking tab mates with the locking slot to prevent counter rotation by engagement of the locking tab with the stop surface.

13. The twist-lock connector of claim 12 wherein a support post is positioned on the inside of the insertion portion to prevent the locking arm from over deflection.

* * * * *